US007260344B2

(12) United States Patent
Shin et al.

(10) Patent No.: US 7,260,344 B2
(45) Date of Patent: Aug. 21, 2007

(54) LIQUID DEVELOPING DEVICE

(75) Inventors: Joong-gwang Shin, Soongnam-si (KR); In-yong Song, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 77 days.

(21) Appl. No.: 11/024,802

(22) Filed: Dec. 30, 2004

(65) Prior Publication Data

US 2005/0158082 A1 Jul. 21, 2005

(30) Foreign Application Priority Data

Jan. 20, 2004 (KR) ..... 10-2004-0004428

(51) Int. Cl.
*G03G 15/10* (2006.01)

(52) U.S. Cl. ..... 399/237; 399/238

(58) Field of Classification Search ..... None
See application file for complete search history.

(56) References Cited

U.S. PATENT DOCUMENTS

| | | | | |
|---|---|---|---|---|
| 5,255,058 | A | 10/1993 | Pinhas et al. | |
| 2001/0033930 | A1* | 10/2001 | Kodama | 428/375 |
| 2003/0129005 | A1* | 7/2003 | Kim | 399/238 |

FOREIGN PATENT DOCUMENTS

| | | |
|---|---|---|
| JP | 05-289587 | 11/1993 |
| JP | 05-313501 | 11/1993 |
| JP | 07-334004 | 12/1995 |
| JP | 08-278735 | 10/1996 |
| JP | 09-281809 | 10/1997 |
| JP | 09-297467 | 11/1997 |
| JP | 10-177304 | 6/1998 |
| JP | 2000-010446 | 1/2000 |
| KR | 2000-9248 A | 2/2000 |

* cited by examiner

*Primary Examiner*—Vincent Q. Nguyen
(74) *Attorney, Agent, or Firm*—Stanzione & Kim, LLP

(57) ABSTRACT

A liquid developing device includes an ink cartridge, a developing container connected to the ink cartridge in which ink is circulated between the developing container and the ink cartridge, a photosensitive body on which an electrostatic latent image is formed, a developing roller facing the photosensitive body, being rotatable to supply the ink to the electrostatic latent image, and a depositing member being installed to maintain a depositing gap between the depositing member and the developing roller and to attach the ink to the developing roller by a potential difference, wherein the developing container includes a first developing container having an outlet opened in a lengthwise direction and an inlet connected to the ink cartridge at a position lower than the outlet, and a second developing container in which ink overflowing from the first developing container via the outlet is stored and which has a drawing hole connected to the ink cartridge, and the ink supplied from the ink cartridge to the first developing container via the inlet overflows and is supplied to the depositing gap via the outlet, some of the ink is attached to the developing roller, and the remaining ink is stored in the second developing container and is drawn into the ink cartridge.

20 Claims, 5 Drawing Sheets

LIQUID DEVELOPING DEVICE

CROSS-REFERENCE TO RELATED APPLICATIONS

This application claims the priority under 35 U.S.C. §119 of Korean Patent Application No. 2004-4428, filed on Jan. 20, 2004, in the Korean Intellectual Property Office, the disclosure of which is incorporated herein in its entirety and by reference.

BACKGROUND OF THE INVENTION

1. Field of the Invention

The present general inventive concept relates to a developing device, and more particularly, to a liquid developing device using a liquid developing agent having a high concentration.

2. Description of the Related Art

A liquid developing agent is a developing agent in which powdery toner particles are dispersed into a liquid carrier (solvent). Hereinafter, the liquid developing agent is referred to as ink. A liquid developing device is a device which develops an electrostatic latent image formed on a photosensitive body by supplying the ink to the electrostatic latent image.

FIG. 1 shows an example of the structure of a conventional liquid developing device disclosed in U.S. Pat. No. 5,255,058. Referring to FIG. 1, an electrostatic latent image is formed on a photosensitive body 10, and an ink supply unit develops the electrostatic latent image by supplying ink to the photosensitive body 10. The developed electrostatic latent image on the photosensitive body 10 is transferred to a transfer body 30, and the transfer body 30 prints the image on a sheet of paper 72.

The ink supply unit prepares the ink having a toner concentration less than 3% solid and supplies the ink between the photosensitive body 10 and a developing roller 38. To this end, the ink supply unit includes concentrated cartridges 82 and 84 in which concentrated ink having a toner concentration of about 25% solid is stored, a solvent cartridge 86 in which a pure solvent is stored, mixing tanks 55, 57, 59, and 61 which mix the concentrated ink with the pure solvent to prepare ink having a uniform concentration of about 2-3% solid, a supplying portion 20 which supplies the ink stored in the mixing tanks 55, 57, 59, and 61 to the developing roller 38 by pumping the ink into pumps 90, 92, 94, and 96, and a drawing portion which draws the ink remaining after the electrostatic latent image is developed. The drawing portion includes a collecting container 50 which collects the ink dropping after being supplied to the developing roller 38 and the photosensitive body 10 and returns the ink to the mixing tanks 55, 57, 59, and 61 for different colors, a squeeze roller 26 which presses the photosensitive body 10 on which the image is developed and squeezes a solvent contained in the developed image, and a separator 66 which draws the squeezed ink from the collecting container 50, separates toner from the ink, and returns the solvent to a solvent tank 65.

In order to perform a development operation using the conventional liquid developing device having the above structure, first, four colors of ink, such as yellow (Y), magenta (M), cyan (C), and black (K), each having the concentration of 2-3% solid, are prepared in the mixing tanks 55, 57, 59, and 61, respectively. In a case of a system for performing a development operation using a single color, such as black-and white, only one color ink is prepared.

Here, in order to realize a color image, a system for preparing the four colors of ink has been disclosed. In order to prepare each of the four colors of ink, the ink supply unit supplies the concentration ink and the pure solvent from the concentrated cartridges 82 and 84 and the solvent cartridge 86, respectively, to each of the mixing tanks 55, 57, 59, and 61, so as to manufacture the four colors of ink, each having a corresponding concentration. To this end, a concentration sensor (not shown) is provided to each of the mixing tanks 55, 57, 59, and 61 and measures the concentration of the mixed ink. If the ink is prepared in this manner, the development operation starts performing. First, a charger 14 charges the photosensitive body 10 to a predetermined potential. Then, a laser scanning unit (LSU) 16 radiates light onto the charged photosensitive body 10 to form an electrostatic latent image corresponding to a desired image by a potential difference between a portion of the photosensitive body 10 onto which light is irradiated and a portion of the photosensitive body 10 onto which light is not irradiated. Subsequently, by operating the pumps 90, 92, 94, and 96, the supplying portion 20 supplies the ink stored in the mixing tanks 55, 57, 59, and 61 between the developing roller 38 and the photosensitive body 10 to form the electrostatic latent image. The developed image is transferred to a transfer roller 30, and if the image has only one color, the image in this state is directly printed on the sheet of paper 72. However, if a color image needs to be realized by superimposing a plurality of colors of ink, the above-described charge, exposure, and development operations are repeatedly performed on each of the four colors, such as yellow (Y), magenta (M), cyan (C), and black (K) so that the developed image for each color is superimposed on the transfer roller 30. Last, the color image formed by superimposing the developed image for each color is printed on the sheet of paper 72 that passes between the transfer roller 30 and a pressing roller 71.

However, as described above, the structure of the liquid image developing system which performs the steps of preparing, supplying, and drawing ink, is considerably complicated. In other words, the concentrated ink and solvent are stored and prepared in each of the cartridges 82, 84, and 86, returned to the mixing tanks 55, 57, 59, and 61 and mixed with ink having the low concentration less than 3% solid for development, the electrostatic latent image is developed with the ink, and the solvent contained in the developed image should be squeezed and drawn to have a high-concentration state suitable for printing, causing a large load on the size and/or cost of a device.

SUMMARY OF THE INVENTION

The present general inventive concept provides a liquid developing device having a small size and using high-concentration ink.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept are achieved by providing a liquid developing device including an ink cartridge, a developing container connected to the ink cartridge in which ink is circulated between the developing container and the ink cartridge, a photosensitive body on which an electrostatic latent image is formed, a developing roller facing the photosensitive body, being rotatable to supply the ink to the electrostatic latent image, and a depositing member being installed to maintain a depositing gap between the depositing member and the developing roller to attach the ink to the developing roller by a potential difference. The developing container includes a first developing container having an outlet opened in a lengthwise direction and an inlet connected to the ink cartridge at a position lower than the outlet, and a second developing container in which ink overflowing from the first developing container via the outlet is stored and which has a drawing hole connected to the ink cartridge, and the ink supplied from the ink cartridge to the first developing container via the inlet overflows and is supplied to the depositing gap via the outlet, some of the ink is attached to the developing roller, and the remaining ink is stored in the second developing container and is drawn into the ink cartridge.

The device may further include a third developing container in which waste ink removed from the photosensitive body after a development operation performed is stored. The device may further include a waste ink reservoir connected to the third developing container wherein the waste ink stored in the third developing container may be collected in the waste ink reservoir and may be exhausted.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
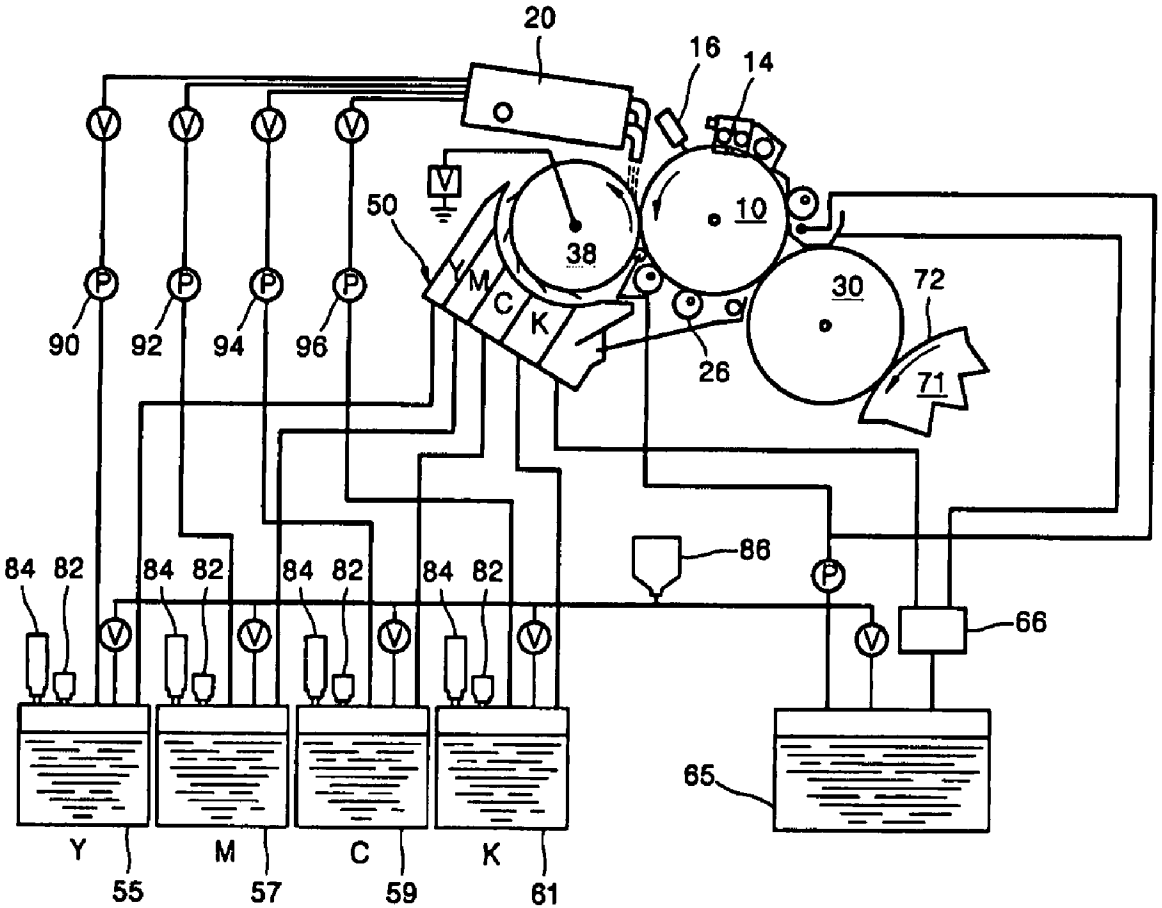
FIG. 1 (PRIOR ART)
FIG. 1 illustrates an example of a structure of a conventional liquid developing device.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

Figure 2:
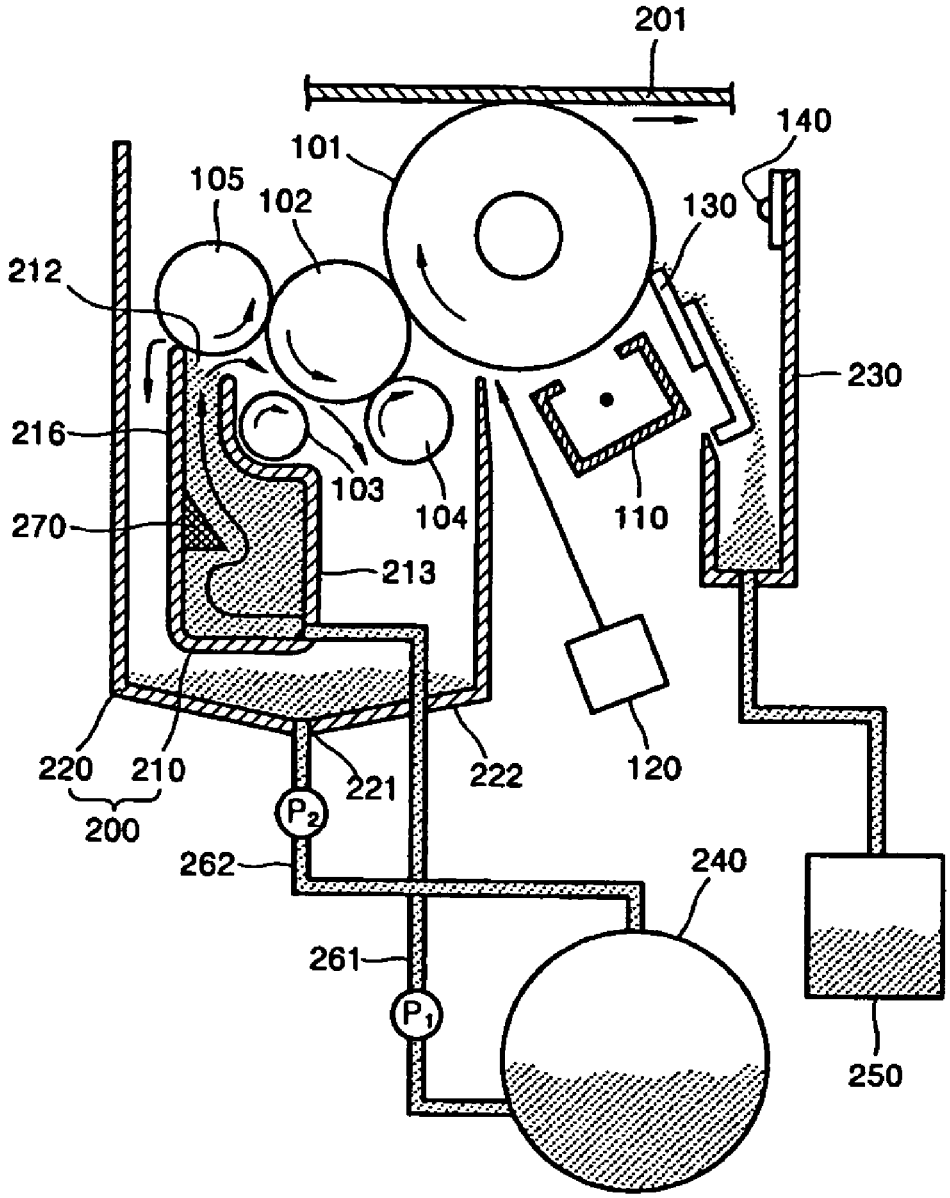
FIG. 2 illustrates a structure of a liquid developing device according to an embodiment of the present general inventive concept.

FIG. 2 shows a structure of a liquid developing device according to an embodiment of the present general inventive concept. Referring to FIG. 2, an electrostatic latent image is formed on a photosensitive drum 101, which is a photosensitive body having a drum shape. A charger 110 charges a surface of the photosensitive drum 101 to a uniform potential. A corona discharger can be used as the charger 110. An exposure unit 120 radiates light corresponding to image information onto the surface of the photosensitive drum 110 charged by the charger 110 to the uniform potential. A laser scanning unit can be used as the exposure unit 120. A cleaning blade (cleaning unit) 130 scrapes off ink remaining on the surface of the photosensitive drum 101 after the image formed on the photosensitive drum 101 is transferred to a transfer body 201. The transfer body 201 may be a sheet of paper or other printing medium onto which the image is finally transferred, or an intermediate transfer body, such as a transfer belt. An eraser 140 removes the charge remaining on the surface of the photosensitive drum 101 after the image formed on the photosensitive drum 101 is transferred to the transfer body 201.

A developing roller 102 faces the photosensitive drum 101 and is rotated in a direction opposite to a rotation direction of the photosensitive drum 101, that is, in a direction in which a surface of the developing roller 102 moves in the same direction as the direction of the surface of the photosensitive drum 101 in an area (developing area) that faces the photosensitive drum 101. The developing roller 102 develops the electrostatic latent image by supplying ink to the electrostatic latent image. The developing roller 102 can be rotated while contacting the photosensitive drum 101. The developing roller 102 can be formed of polyurethane rubber or elastomer such as NBR, for example. The developing roller 102 can have a hardness of Shore A 25-65 degrees and a surface roughness (Ra) of 1-4 μm. The developing roller 102 can also have resistance of about $10^5$-$10^8$ Ω. As shown in FIG. 2, the developing roller 102 can contact the photosensitive drum 101 but the scope of the present general inventive concept is not limiting. The developing roller 102 may be rotated while being spaced apart from the photosensitive drum 102 by a predetermined developing gap, for example, 50-500 μm.

A depositing roller (depositing member) 103 attaches the ink to the developing roller 102. The depositing roller 103 can be rotated at a depositing gap between the depositing roller 103 and the developing roller 102. The depositing roller 103 can be rotated in a direction opposite to a rotation direction of the developing roller 102, that is, in a direction in which a surface of the depositing roller 103 moves in the same direction as the direction of the surface of the developing roller 102 at the depositing gap. The depositing roller 103 may not be rotated or may stop rotating. The depositing member in a stoppage state may not have a roller shape. A metering roller 104 is rotated while contacting the developing roller 102. The metering roller 104 can be rotated in a direction in which a surface of the metering roller 104 moves in the same direction as the direction of the surface of the developing roller 102 at a portion of the metering roller 104 that contacts the developing roller 102, that is, in a direction opposite to a rotation direction of the developing roller 102. The metering roller 104 regulates the amount of ink attached to the developing roller 102 to a constant level. The metering roller 104 can be formed of a metallic material. A cleaning roller 105 removes ink remaining on the developing roller 102 after a development operation is performed. The cleaning roller 105 can be rotated in the same direction as the direction of the developing roller 102, that is, in a direction in which a surface of the cleaning roller 105 moves in a direction opposite to the direction of the surface of the developing roller 102 at a portion of the cleaning roller 105 that contacts the developing roller 102. The cleaning roller 105 may be formed of a sponge which absorbs ink.

A developing container 200 and an ink cartridge 240 are shown in FIG. 2. Ink having a high concentration of 3-40% solid, and preferably 3-18% solid, is stored in the ink cartridge 240. The ink is formed by dispersing powdery toner particles into a liquid carrier. The developing container 200 is connected to the ink cartridge 240, and the ink is circulated therebetween. The developing container 200 includes first and second developing containers 210 and 220. The first developing container 210 is installed in the second developing container 220. The first and second developing containers 210 and 220 are connected to the ink cartridge 240 via first and second ink paths 261 and 262. Pumps P1 and P2 can be installed on the first and second ink paths 261 and 262. Waste ink removed from the photosensitive drum 101 using the cleaning blade 130 can be stored in a third developing container 230. The ink is supplied from the ink cartridge 240 to the first developing container 210 via the first ink path 261, and the ink overflowing from the first developing container 210 is stored in the second developing container 220 and drawn back into the ink cartridge 240 via the second ink path 262.

Figure 3:
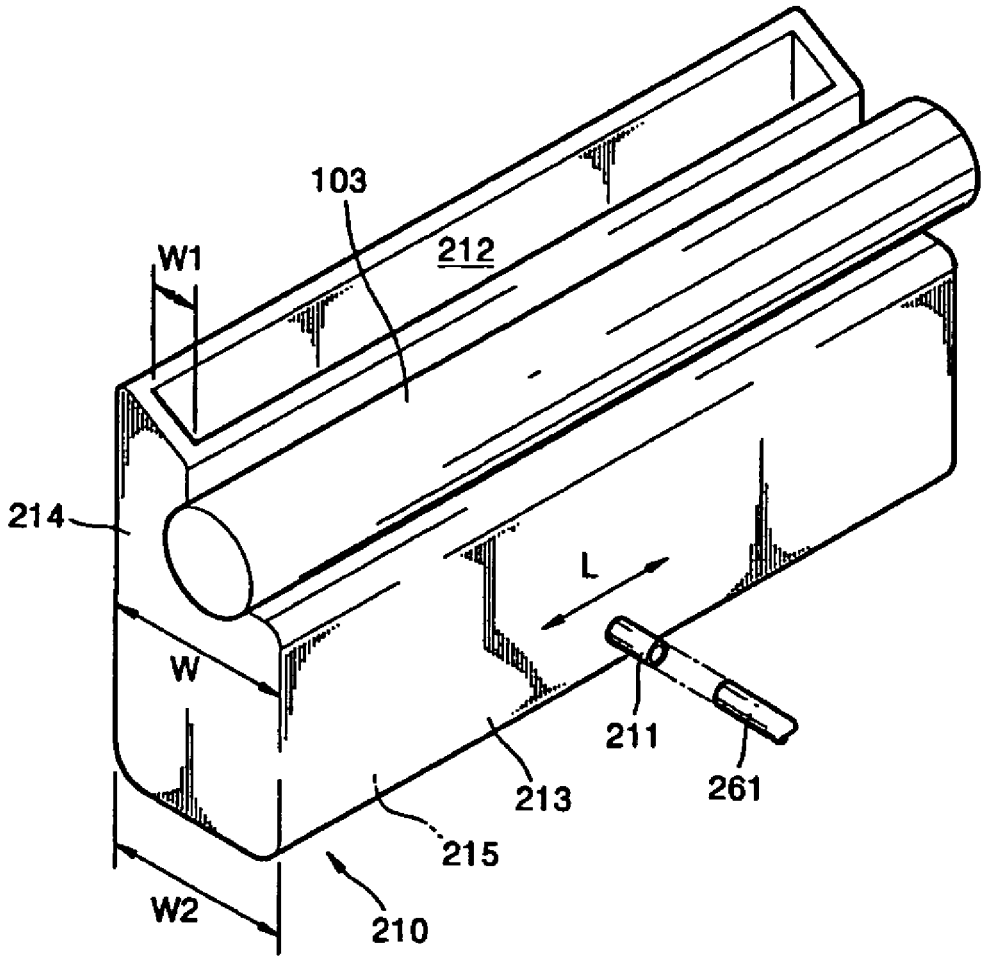
FIG. 3 illustrates a perspective view of a first developing container.

FIG. 3 is a perspective view of the first developing container 210. Referring to FIGS. 2 and 3, an inlet 211 can be formed at the first developing container 210. The inlet 211 is connected to the first ink path 261. An outlet 212 can be formed at a top surface of the first developing container 210. The inlet 211 can be formed at a lower position than the outlet 212. In this embodiment, ink flowing into the first developing container 210 via the inlet 211 rises toward the outlet 212 and is supplied to a depositing gap. The inlet 211 can be formed at a first sidewall 213 in a lengthwise direction L of the first developing container 210. The inlet 211 can be formed at the center of the lengthwise direction L of the first sidewall 213. In addition, the inlet 211 can be formed at the lowest position possible. As shown in FIG. 3, the inlet 211 can be formed at lower edges of the first sidewall 213. The first developing container 210 can extend from the outlet 212 in a downward direction such that a width W increases towards a lower portion 215 of the first developing container 210. For example, a width W1 of the outlet 212 is smaller than a width W2 of the lower portion 215 of the first developing container 210. The first developing container 210 may include a bottleneck portion 214 that extends from the outlet in the downward direction. In the embodiment illustrated in FIG. 3, the width W1 of the outlet 212 is about 50% of a width W2 of the lower portion 215 of the first developing container 210. However, the ratio between the width W1 of the outlet 212 and the width W2 of the lower portion 215 of the first developing container 210 may be determined by a predetermined calculation which provides the intended purpose of this feature of the present general inventive concept.

Figure 4:
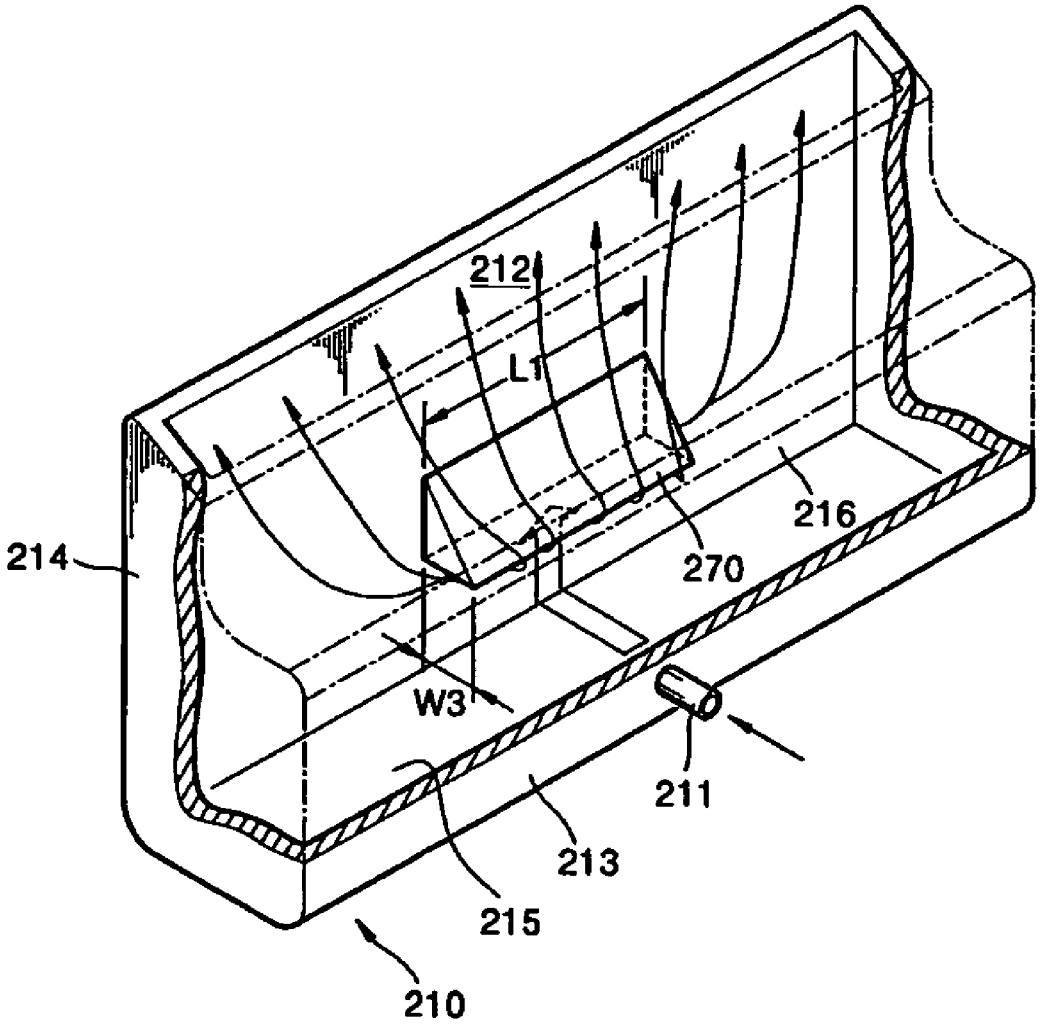
FIG. 4 illustrates a partial cutting perspective view of the first developing container of FIG. 3.

FIG. 4 is a partial cutting perspective view of the first developing container 210. Referring to FIGS. 2 and 4, a flow guide 270 can be formed between the inlet 211 and the outlet 212. The flow guide 270 extends in a lengthwise direction of the first sidewall 213 to allow the ink flowing into the first developing container 210 via the inlet 211 to rise toward the outlet 212. The flow guide 270 can be installed at a second sidewall 216 that faces the first sidewall 213. A length L1 and a width W3 of the flow guide 270 are determined so that the ink is uniformly dispersed into the entire area of the outlet 212.

Referring to FIG. 2, the second developing container 220 can have a drawing hole 221. The drawing hole 221 can be formed at a lower portion 222 of the second developing container 220. The lower portion 222 of the second developing container 220 can be inclined toward the drawing hole 221 in a downward direction.

As shown in FIG. 2, the liquid developing device may further include a waste ink reservoir 250. The waste ink reservoir 250 can be connected to the third developing container 230. Waste ink removed from the photosensitive drum 101 using the cleaning blade 130 and collected in the third developing container 230 cannot be repeatedly used and can be collected in the waste ink reservoir 250 and wasted.

An operation of the liquid developing device according to the present general inventive concept will now be described with reference to FIGS. 2 through 4.

The exposure unit 120 radiates light corresponding to image information onto the surface of the photosensitive drum 101 charged by the charger 110 to the uniform potential. Then, an electrostatic latent image is formed by a potential difference between a portion of the photosensitive drum 101 onto which light is irradiated and a portion of the photosensitive drum 101 onto which light is not irradiated.

When the pump P1 operates, ink having the concentration of 3-40% solid stored in the ink cartridge 240 flows into the first developing container 210 along the first ink path 261 without a separate dilution process. If the inlet 211 is not formed at the lower portion 215 of the first developing container 210, the ink directly rises toward the outlet 212. Thus, the ink is exhausted into only an area of the outlet 212 corresponding to a right upward direction of the inlet 211, and it is difficult to supply the ink uniformly to the depositing gap. In addition, since pressure is directly applied from the pump P1 to the outlet 212, an eddy current may occur in the outlet 212. When the inlet 211 is formed at the first sidewall 213, and at the lower portion 215 of the first developing container 210, as shown in FIGS. 3-4, the ink flows into the first developing container 210 horizontally, collides with the second sidewall 216, and rises toward the outlet 212 along the second sidewall 216. Thus, the occurrence of the eddy current in the outlet 212 can be prevented.

Referring to FIG. 4, the flow guide 270 is disposed between the outlet 212 and the inlet 211. The ink flowing into the inlet 211 collides with the second sidewall 216, rises toward the outlet 212, and collides with the flow guide 270. Then, the ink goes around the flow guide 270 and is dispersed into the lengthwise direction of the first developing container 210. Thus, the ink can be uniformly exhausted into the entire area of the outlet 212. In addition, since the bottleneck portion 214 that extends from the outlet 212 in a downward direction promotes the flow of the ink, a sufficient amount of the ink can be supplied to the outlet 212 using a small pumping pressure.

The ink exhausted from the outlet 212 flows into the depositing gap where the developing roller 102 and the depositing roller 103 face each other. The depositing gap may be set to about 50-500 μm, and preferably 200-300 μm. A depositing bias voltage is applied to the depositing roller 103 so that ink, more specifically, toner particles dispersed into the ink, are attached to the developing roller 102. The toner particles dispersed into the ink may be positively charged. The depositing bias voltage may be about 500-1000V. A developing bias voltage is applied to the developing roller 102 so that toner particles from the ink are attached to the electrostatic latent image formed on the photosensitive drum 101. The developing bias voltage is about 300-550V. The developing bias voltage and the depositing bias voltage can be determined in consideration of elements, such as a charging polarity and a charging amount of the toner particles, and the potential of the electrostatic latent image.

If ink having a concentration of 3-18% solid is supplied to the depositing gap, for example, the concentration of the ink attached to the surface of the developing roller 102 that has passed through the depositing gap can be about 6-20% solid. In this case, the amount (mass/area (M/A)) of the toner particles attached to a unit area of the developing roller 102 is about 400-1100 μg/cm$^2$. In order to obtain an image having a uniform concentration, the concentration of the ink supplied to a developing area and the amount of the toner particles should be uniform regardless of the concentration of the ink supplied to the depositing gap. To this end, as shown in FIG. 2, the metering roller 104 contacts the developing roller 102 and is rotated. A metering bias voltage is applied to the metering roller 104. The metering bias voltage applied to the metering roller 104 can be the same as the depositing bias voltage. The concentration of the ink and the amount of the toner particles attached to the developing roller 102 that has passed through the metering roller 104 can be determined by a correlation between a pressure at which the metering roller 104 contacts the developing roller 102, a rotational line velocity, an adhering force of the toner particles to the developing roller 102, and the size of the metering bias voltage. The ink regulated by the metering roller 104 and removed from the developing roller 102 drops into the second developing container 220. The ink remaining on the surface of the developing roller 102 that has passed through the metering roller 104 can have a concentration of about 18-36% solid, and the toner particles having a concentration of about 150-500 μg/cm$^2$ can be attached to the surface of the developing roller 102. The ink passes through an area where the developing roller 102 faces the photosensitive drum 101 and is attached to the electrostatic latent image formed on the photosensitive drum 101 by the developing bias voltage.

The ink remaining on the surface of the developing roller 102 that has passed through the developing area is removed using the cleaning roller 105. The cleaning roller 105 contacts an end of the second sidewall 216 of the first developing container 210. Thus, the cleaning roller 105 can have a sponge shape and absorbs the ink from the developing roller 102. The absorbed ink is drawn into the second developing container 220 when the cleaning roller 105 contacts the second sidewall 216. The ink collected in the developing container 220 is drawn into the ink cartridge 240 via the drawing hole 221 and the second ink path 262 as the pump P2 operates.

By performing the above-described operations, the ink supplied from the ink cartridge 240 to the first developing container 210 overflows and is supplied to the depositing gap via the outlet 212. In this case, a circulation procedure in which some of the ink is attached to the developing roller 102 and is supplied to the developing area while the remaining ink is stored in the second developing container 220 and is drawn into the ink cartridge 240, is repeatedly performed so that the amount of the ink supplied to the developing area is supplied at a constant level even though the ink having the wide concentration range of 3-40% solid is used. If the ink remains in the first developing container 210 while the development operation is not performed, the ink can become dried, and the toner particles can attach to inner walls of the first developing container 210. To prevent this phenomenon, if the development operation is not performed, the pump P1 can operate reversely, and the ink stored in the first developing container 210 can be drawn into the ink cartridge 240.

The image formed on the surface of the photosensitive drum 101 is transferred to the transfer body 201. The waste ink remaining on the surface of the photosensitive drum 101 after the image is transferred to the transfer body 201 is removed using the cleaning blade 130, drawn into the third developing container 230, and is transferred to the waste ink reservoir 250 and exhausted.

Figure 5:
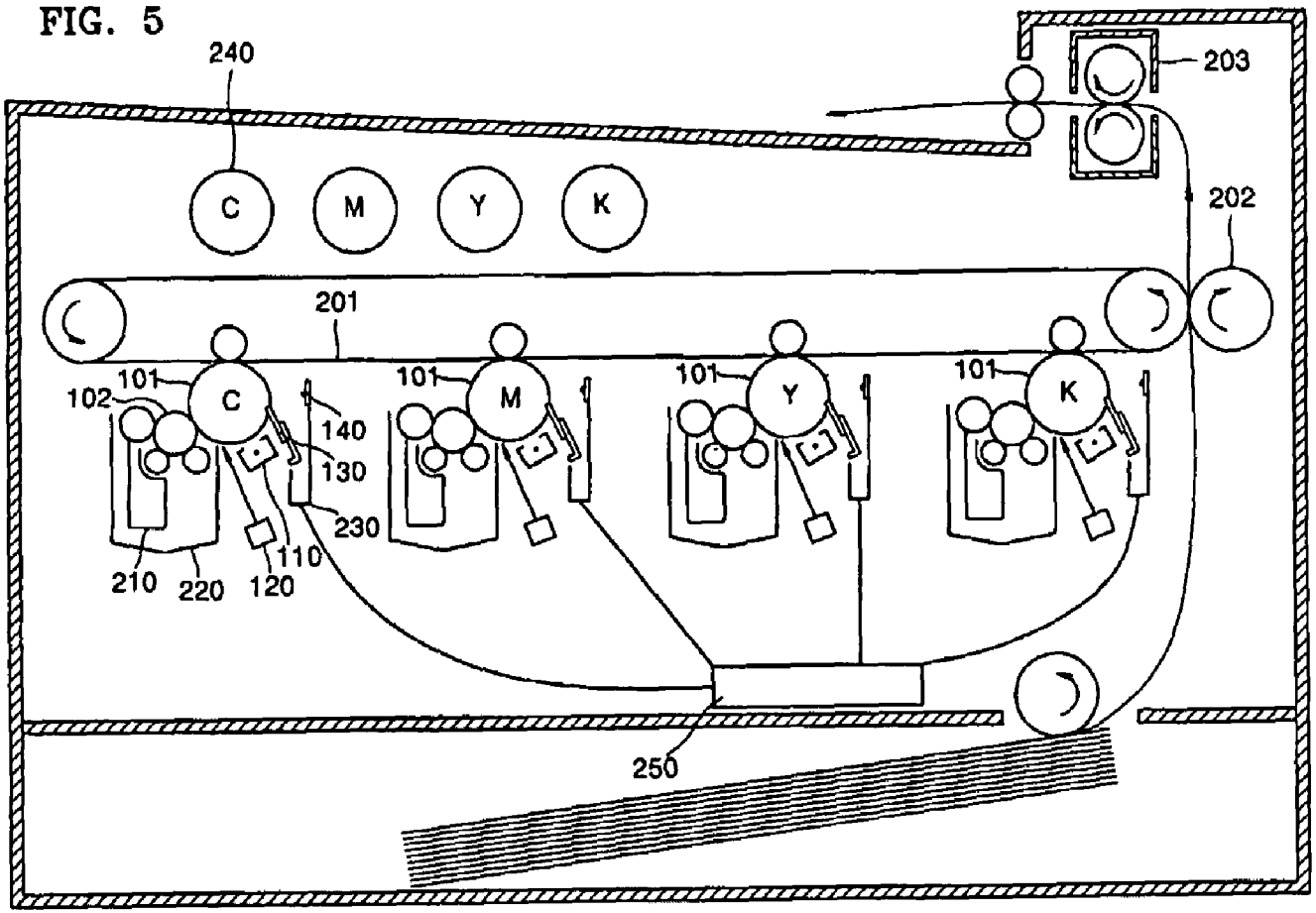
FIG. 5 illustrates the structure of a liquid color printer having the liquid developing device of FIG. 1.

Only one liquid developing device is provided to a printer using a single color. However, in the case of a color printer to print a color image by superimposing a plurality of colors, a liquid developing device corresponding to each color is provided, as shown in FIG. 5. Referring to FIG. 5, liquid developing devices C, M, Y and K corresponding to the colors cyan, magenta, yellow and black, respectively, are provided to a multicolor printer. Each of the liquid developing devices C, M, Y and K are similar to the liquid developing device of FIG. 2, so a detailed description is omitted. A color image that has been superimposed on and transferred to the transfer body 201 (illustrated as the transfer belt in FIG. 5) from a respective photosensitive drum 101 of each of the liquid developing devices C, M, Y, K is transferred onto a sheet of paper that passes between a transfer roller 202 and the transfer belt 201. A fusing unit 203 fuses the color image transferred onto the paper by heating and pressing the color image so that printing of the color image is complete. Only one waste ink reservoir 250 may be disposed for all of the developing devices C, M, Y and K, as shown in FIG. 5, or a waste ink reservoir 250 for each developing device C, M, Y and K may be disposed.

As described above, the liquid developing device according to the present general inventive concept has the following advantageous effects. Since ink having a high concentration is directly supplied to a developing container without diluting the ink and a development operation is performed, an ink supply structure can be simplified, and a printer can be made smaller. Furthermore, the developing container is classified into first and second developing containers, in which ink used in performing the development operation is circulated, and a third developing container, in which disposable ink is stored, so the ink can be prevented from staying in the developing container and becoming dry and unusable. In addition, the ink flows into the first developing container horizontally such that the occurrence of an eddy current of the ink is prevented. Furthermore, a flow guide is disposed between an inlet and an outlet such that the ink is uniformly supplied to an entire depositing gap. Furthermore, the first developing container includes a bottleneck portion such that the ink is supplied using a small pumping pressure, and because of the development operation using a high-concentration developing agent, a squeezing process can be omitted. Furthermore, because of the omission of the squeezing process, a time required to perform the development operation can be reduced, and a printing operation can be performed at a higher speed.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A liquid developing device comprising an ink cartridge, a developing container connected to the ink cartridge in which ink is circulated between the developing container and the ink cartridge, a photosensitive body on which an electrostatic latent image is formed, a developing roller facing the photosensitive body and rotatable to supply the ink to the electrostatic latent image, and a depositing member being installed to maintain a depositing gap between the depositing member and the developing roller and to attach the ink to the developing roller, wherein the developing container comprises:

a first developing container having an outlet to supply the ink to the depositing gap opened in a lengthwise direction and an inlet connected to the ink cartridge at a position lower than the outlet; and a second developing container in which ink overflowing from the first developing container via the outlet is stored and which has a drawing hole connected to the ink cartridge, and the ink supplied from the ink cartridge to the first developing container via the inlet overflows and is supplied to the depositing gap via the outlet, where some of the ink is attached to the developing roller and the remaining ink is stored in the second developing container and is drawn back into the ink cartridge.

2. The device of claim 1, further comprising a third developing container in which waste ink removed from the photosensitive body after a development operation is performed is stored.

3. The device of claim 2, further comprising a waste ink reservoir connected to the third developing container, wherein the waste ink stored in the third developing container is collected in the waste ink reservoir and is exhausted.

4. The device of claim 1, wherein the first developing container is installed in the second developing container.

5. The device of claim 1, wherein the inlet is disposed at a first sidewall in a lengthwise direction of the first developing container, and the ink flows into the first developing container horizontally and then rises toward the outlet.

6. The device of claim 5, wherein the inlet is disposed at the center of lower edges of the first sidewall.

7. The device of claim 1, wherein a width of the outlet is smaller than a width of a lower portion of the first developing container.

8. The device of claim 7, wherein the first developing container further includes a bottleneck that extends from the outlet in a downward direction.

9. The device of claim 1, further comprising a flow guide extending in the lengthwise direction of the first developing container and being disposed between the inlet and the outlet, wherein the ink goes around the flow guide, is dispersed into the lengthwise direction and rises toward the outlet.

10. The device of claim 9, wherein the flow guide is installed at a second sidewall that faces the first sidewall.

11. The device of claim 1, further comprising a flow guide extending in the lengthwise direction of the first developing container and being disposed between the inlet and the outlet, wherein the inlet is disposed at the lower edges of the first sidewall in the lengthwise direction of the first developing container, and the ink flows into the first developing container horizontally, goes around the flow guide, is dispersed into the lengthwise direction, and rises toward the outlet.

12. The device of claim 11, wherein the width of the outlet is smaller than the width of the lower portion of the first developing container, and the first developing container further includes a flow guide that extends from the outlet in a downward direction, and the flow guide is disposed between the inlet and the bottleneck portion.

13. The device of claim 1, wherein the drawing hole is formed at a lower portion of the second developing container.

14. The device of claim 13, wherein the lower portion of the second developing container is inclined toward the drawing hole in a downward direction.

15. The device of claim 1, wherein the developing roller is a semiconductive roller having elasticity and contacts the photosensitive body.

16. The device of claim 15, wherein the developing roller has resistance of about $10^5$-$10^8\Omega$.

17. The device of claim 1, wherein the depositing gap is 50-500 μm.

18. The device of claim 1, wherein the depositing member has a roller shape in which the surface of the depositing roller is in the same direction as the direction of the surface of the developing roller at the depositing gap.

19. The device of claim 1, further comprising a metering roller rotated while contacting the developing roller and regulating the amount of the ink attached to the surface of the developing roller to a constant level.

20. The device of claim 1, further comprising a cleaning roller rotated while contacting the developing roller and removing the ink remaining on the surface of the developing roller after the ink is supplied to the photosensitive body.

* * * * *